US006651749B1

(12) United States Patent
Kilgore

(10) Patent No.: US 6,651,749 B1
(45) Date of Patent: Nov. 25, 2003

(54) WELL TOOL ACTUATORS AND METHOD

(75) Inventor: Marion D. Kilgore, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/540,001

(22) Filed: Mar. 30, 2000

(51) Int. Cl.[7] ..... E21B 23/04; E21B 23/06

(52) U.S. Cl. ..... 166/387; 166/106; 166/122; 166/381

(58) Field of Search ..... 166/387, 120, 166/122, 212, 381, 72, 106

(56) References Cited

U.S. PATENT DOCUMENTS

| | | | | | |
|---|---|---|---|---|---|
| 2,839,142 | A | * | 6/1958 | Huber | 166/135 |
| 3,066,739 | A | * | 12/1962 | Saurenman et al. | 166/141 |
| 3,283,820 | A | | 11/1966 | Tausch | 166/120 |
| 3,577,782 | A | * | 5/1971 | Aitken | 73/152.26 |
| 4,554,973 | A | * | 11/1985 | Shonrock et al. | 166/192 |
| 4,760,741 | A | * | 8/1988 | Koopmans et al. | 73/152.59 |
| 4,892,149 | A | * | 1/1990 | Hoes et al. | 166/208 |
| 5,238,070 | A | | 8/1993 | Schultz | 166/386 |
| 5,404,956 | A | | 4/1995 | Bohlen | 166/387 |
| 5,429,036 | A | * | 7/1995 | Latos | 60/327 |
| 5,579,840 | A | | 12/1996 | Saurer | 166/123 |
| 5,791,412 | A | * | 8/1998 | Myhre | 166/106 |
| 5,897,095 | A | | 4/1999 | Hickey | 251/57 |

FOREIGN PATENT DOCUMENTS

| | | |
|---|---|---|
| GB | 2304357 | 3/1997 |
| GB | 2 334 285 | 8/1999 |

OTHER PUBLICATIONS

"The Dynamic Trio" (7 pages) Sherex Industries, 1400 Commerce Parkway, Lancaster, New York 14086—date: unknown.

* cited by examiner

*Primary Examiner*—Hoang Dang
(74) *Attorney, Agent, or Firm*—Peter V. Schroeder

(57) ABSTRACT

The present inventions contemplate an improved well tool actuator and method that does not require more expensive downhole equipment and can be utilized with limited actuation pressures.

According to the improved well tool actuator and method of the present inventions, a fluid pressure intensifier is placed in the well and coupled to the downhole device to be manipulated. By using a fluid pressure intensifier the actuation pressure can be increased to a pressure sufficient to operate or manipulate the downhole device without the necessity of increasing the tubing pressure. According to the present invention the actuation pressures supplied by the intensifier can exceed the safe operating rated pressures of the well tubing and equipment. The well tool actuators of the present invention are self-contained in that they are powered from the tubing fluid pressure itself without a high-pressure hydraulic or electrical connection to the surface.

According to the present inventions, subterranean hydraulically actuated well tools can be actuated at higher pressures than the supplied pressure. Fluid pressure intensifiers circuits can be assembled in and carried downhole with the actuation tool and removed once the actuation process is complete. Also, fluid pressure intensifier circuits can be assembled as a part of the well tool and operated remotely.

21 Claims, 3 Drawing Sheets

WELL TOOL ACTUATORS AND METHOD

TECHNICAL FIELD

The present inventions relate to improvements in tools and methods used in subterranean wells used to manipulate downhole apparatus. More particularly the present inventions relate to a downhole fluid powered tool which can be placed in a well and utilizes downhole pressure differentials to power the tool and use it to manipulate downhole apparatus.

BACKGROUND OF THE INVENTIONS

Devices located downhole in a well that require downhole manipulation include packers, valves, side doors, and the like. Some of these devices are pressure actuated or manipulated. For example production packers are run in a well and moved from an unset to a set condition by temporarily plugging the production tubing and thereafter increasing the tubing pressure to move a piston in the packer assembly. Setting pressures are limited by the capacity of the available pumping equipment and by the safety pressure ratings of the surface equipment and production tubing. It is not unusual to find well operators that limit surface and tubing pressures on their wells to 3000 to 4000 psi for use in setting downhole equipment. In such wells as those requiring larger bore hydraulic set packers with resultant small setting-piston areas, surface pressure limitations can result in setting forces so low that the performance of the packer may be compromised. Although more expensive specially designed packers such as those with dual setting pistons can be used, the associated increased costs are undesirable.

SUMMARY OF THE INVENTIONS

The present inventions contemplate an improved well tool actuator and method does not require more expensive downhole equipment and can be utilized with limited actuation pressures.

According to the improved well tool actuator and method of the present inventions, a fluid pressure intensifier, is placed in the well and coupled to the downhole device to be manipulated. Fluid pressure intensifiers are devices that are powered from a supplied pressurized fluid to produce a supply of fluid of higher pressure than the supplied pressurized fluid. Typically intensifiers have oscillating internal pistons or the like that produce a supply of fluid at a pressure increase of one point two times to twenty times the fluid supply pressure. By using a fluid pressure intensifier the actuation pressure can be increased to a pressure sufficient to operate or manipulate the downhole device without the necessity of increasing the tubing pressure. According to the present invention the actuation pressures supplied by the intensifier can exceed the safe operating rated pressures of the well tubings and equipment. The well tool actuators of the present invention are self-contained in that they are powered from the tubing fluid pressure itself without a high-pressure hydraulic or electrical connection to the surface.

According to the present inventions, subterranean hydraulically actuated well tools can be actuated at higher pressures than the supplied pressure. Fluid pressure intensifiers circuits can be assembled in and carried downhole with the actuation tool and removed once the actuation process is complete. Also, fluid pressure intensifier circuits can be assembled as a part of the well tool and operated remotely

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 3:
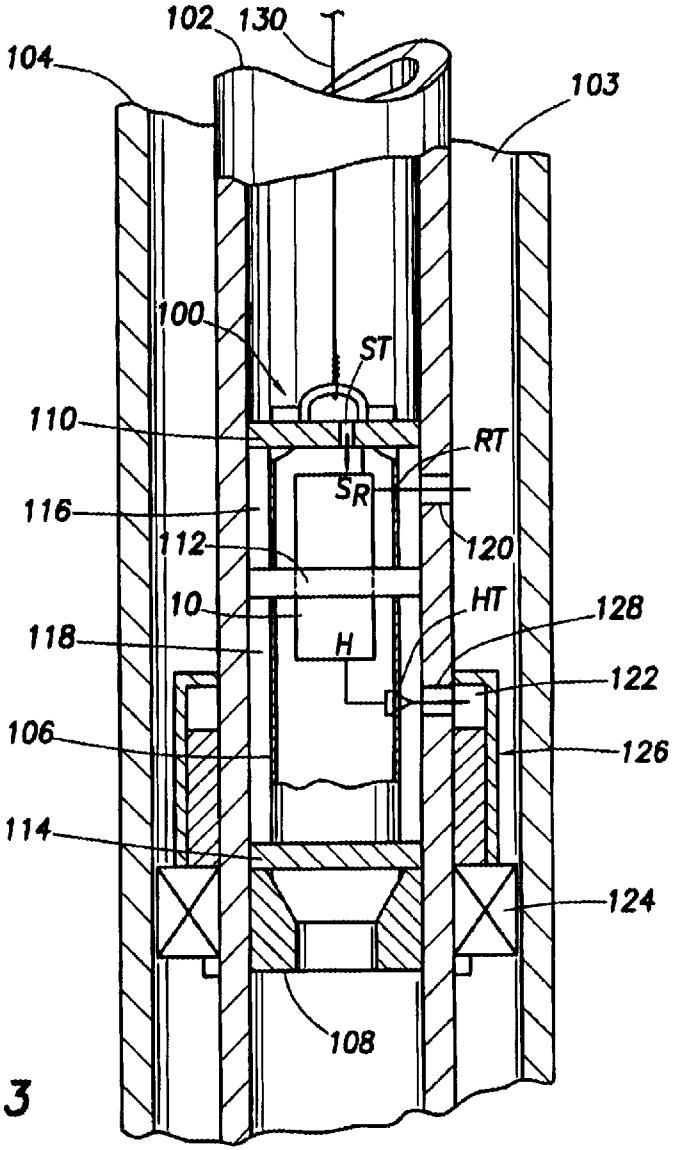
FIG. 3 is a sectional view of a subterranean well location with one embodiment of a well tool configuration according to the present inventions located therein.

The present inventions are described by reference to drawings showing one or more examples of: how the inventions can be made and used. In these drawings, reference characters are used throughout the several views to indicate like or corresponding parts.

Figure 1:
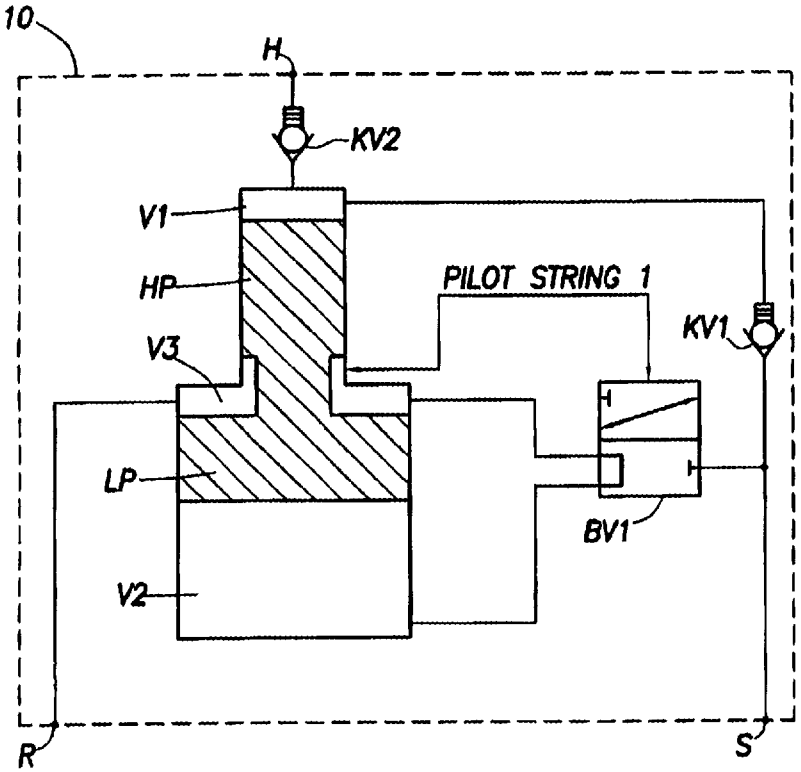
FIG. 1 is a schematic flow diagram of a single fluid pressure intensifier of the type for use in the well tools and methods of the present inventions.

In FIG. 1, a typical fluid schematic for a single action oscillating pump intensifier is illustrated. Intensifiers of this type can be obtained from Sherex Industries of Lancaster, N.Y. as model numbers HC 2–6. Intensifier 10 uses an oscillating pump unit incorporating a low-pressure piston LP, a high-pressure piston HP and a bistable reversing valve BV1.

When hydraulic fluid at system pressure is supplied to port S, fluid first flows freely past check valve KV1, into Vol. 1, past check valve KV2 through high pressure output port H. The term "port" is used herein in a broad generic sense to indicate a location in the flow path rather than any particular structure or shape. At this point all fluid flowing into the intensifier flows through the intensifier and out the high-pressure output port H. If for example the high pressure port H is connected to the chamber of a piston-cylinder actuator assembly, the actuator will move because of the supply of pressurized fluid at port H. When the actuator meets sufficient resistance to stall out, pressure will increase in the high-pressure port H to equal the supply pressure. At that point, check valve KV1 will close and fluid from port S will accumulate in Vol. 1. The bistable valve BV1 connects Vol. 2 to Vol. 3. As pressure is applied to Vol. 1, the pistons LP and HP will move down. During downward movement of the pistons, fluid is forced from Vol. 2, through bistable valve BV1, through Vol. 3 and out discharge or return port R. Simultaneously, as Vol. 1 expands from the downward piston movement fluid from port S fills Vol. 1.

When the pistons are completely down, pilot string 1 is pressurized. This causes the bistable valve BV1 to change position and connect the fluid supply port S and Vol. 2. The pressurized fluid supplied through port S to Vol. 2 causes the pistons LP and HP to move upward. The upward piston movement compresses the fluid in Vol. 1 and causes it to flow through the check valve KV2 and out port H. This pumping action of the pistons delivers fluid at port H at a higher pressure than supply pressure at port S. Once the high-pressure piston HP has moved fully up, pilot string 1 causes bistable valve BV1 to shift to its original position to restart the cycle. The cycle is repeated until the required pressure has been established.

The pressure supplied at port H is determined by the ratio of the area of the low-pressure piston LP divided by the area of the high-pressure piston HP. In some intensifiers ratios of as high as twenty to one have been achieved. This supply of higher-pressure fluid through port H can be used to move an actuator that would have stalled at the lower supply pressure. For example, where fluid is supplied at three thousand psi the intensifier can be used to raise the supply pressure to as much as sixty thousand psi.

Intensifiers of the type described above operate in two steps or stages. In the first step fluid at supply pressure flows at a relatively high volume through the device to the output port H and in turn to any actuator connected thereto. When the actuator encounters sufficient resistance to stall out at supply pressure the intensifier begins the second step or stage where pumping begins. In this second step, fluid is supplied at a lower rate but at a higher pressure to further move the stalled out actuator and complete the actuation cycle. In the second step or stage the intensifier divides the fluid into two components, a high-pressure component at outlet port H and a low-pressure component at return port R.

Figure 2A:
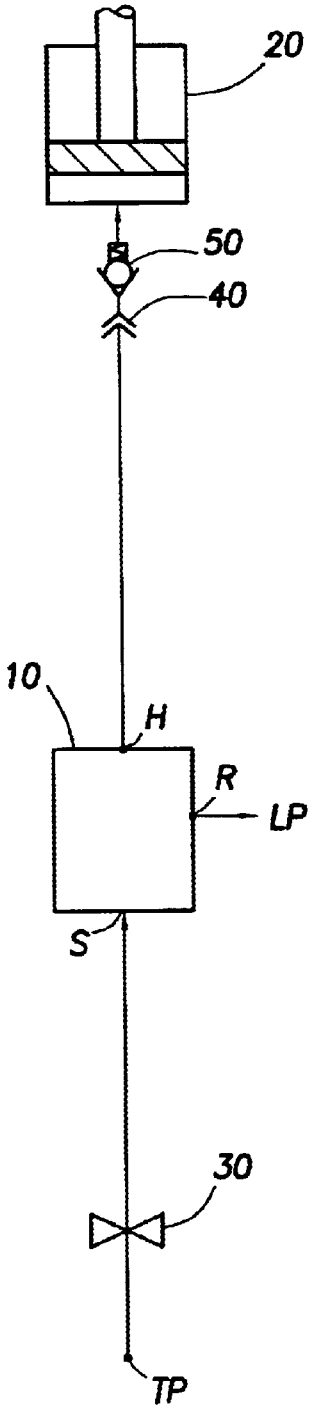
FIGS. 2A–C are schematic tubing diagrams of fluid pressure intensifier circuits for use in the various embodiments and methods of the present inventions.
Figure 2B:
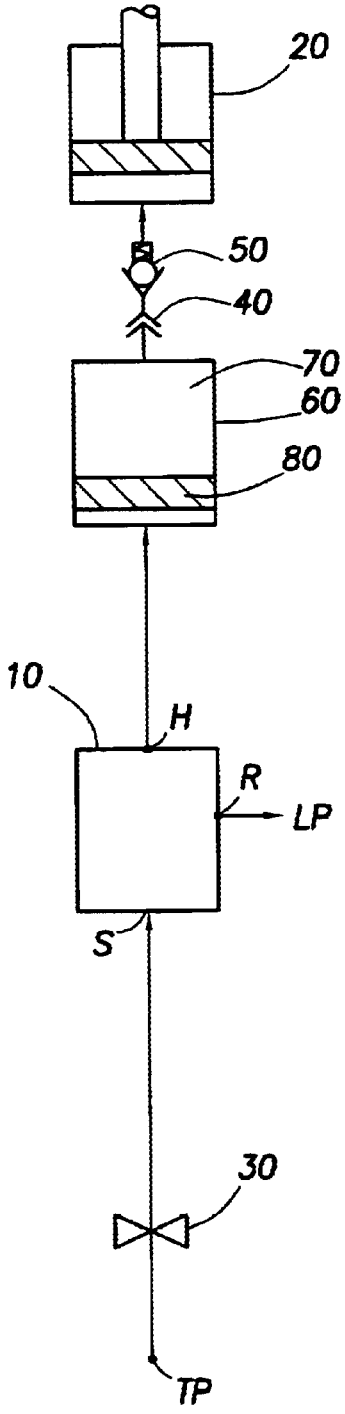
Figure 2C:
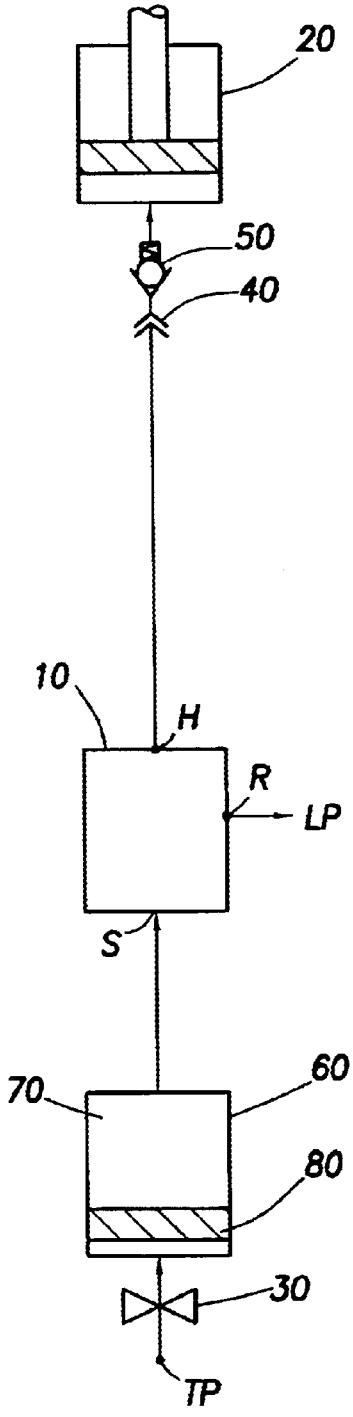

The present inventions utilize intensifiers in tools and methods for fluid actuation of downhole well equipment. In FIGS. 2A–2C, the fluid schematics for three well configurations using fluid pressure intensifiers 10 are illustrated for use with variable volume piston-cylinder actuated equipment such as packer 20. Conventional packer assemblies and other hydraulically actuated downhole tools have both annular and cylindrical piston-cylinder assemblies. When actuating fluid is supplied to the variable volume in the cylinder the piston and cylinder telescope and provide an actuation force to manipulate the packer. Although described herein with respect to downhole hydraulically actuated packers the present inventions are applicable to other types of hydraulically actuated tools. The systems of FIGS. 2A–2C can be used with tubing supply pressures of three thousand psi or lower and can provide actuation pressures as high as sixty thousand psi to the down hole tool without subjecting the tubing string to these higher pressures.

In FIG. 2A the supply port S of intensifier 10 is open to production tubing pressure TP. An optional valve 30 can be used to open or close off port S as is well known in the art. The return port R is open to a lower pressure source such as the annulus between the casing and production tubing (not shown) or a segment of the tubing closed off by a plug (not shown). The high-pressure output port H connected to the variable volume piston-cylinder assembly of packer 20 by a fluid connection 40. Connection 40 can comprise suitable placed packing and ports or other types of downhole releasable connections well known in the art. A check valve 50 (in addition to KV2) can be positioned in the packer 20.

According to the methods of the present invention, intensifier 10 is carried downhole as part of a downhole tool to a location adjacent the packer 20 and connected thereto through connection 40. As will be described the return port R is also connected to a low-pressure source. After valve 30 is opened, intensifier 10 supplies tubing pressure TP to the packer 20 until the packer 20 stalls out and then operates to supply higher pressure fluid to complete the actuation of the packer 20.

In FIG. 2B the fluid system is similar except a hydraulic fluid supply reservoir 60 is carried by the tool and is connected to output port H. Supply 60 consists of a chamber filled with hydraulic fluid 70 with a piston or diaphragm 80 below the fluid. As well fluid is supplied from port H to the space below piston 80, piston 80 is forced to move upward pumping hydraulic fluid 60 though connection 40 and into the actuator of packer 20. In this configuration the packer is isolated from tubing fluids.

FIG. 2C the supply 60 is connected between the tubing fluid inlet TP and the intensifier supply port S. As tubing fluid enters supply 60, hydraulic fluid 70 is supplied to port S. In this configuration both the intensifier and the packer actuator are isolated from well fluids.

In FIG. 3 a well tool assembly 100 according to the present invention is shown in a subterranean location in the tubing 102 of a cased well 104. In the illustrated embodiment tool 100 is a wire line tool used to set a tubing packer. It is envisioned that the tool 100 could be positioned in the well using means other than wire line such as coil and other tubing and the like. For purposes of illustration the tool 100 is shown manipulating a hydraulically actuated tubing packer, but it is to be understood that the teachings of the present inventions apply to other types of hydraulically actuated tools.

Tool 100 has a body 106 shown in contact with landing nipple 108. In the illustrated embodiment upper, center and lower V-packing assemblies 110, 112 and 114, respectively, are axially spaced on the exterior of the body 106 for sealing against the interior wall of tubing 102. These V-packing assemblies define two closed annular chambers 116 and 118.

The supply, return, and high-pressure ports on intensifier 100 are connected to external ports ST, RT, and HT respectively on the tool body 106. Supply port ST is open to the tubing fluid supply above packing 110. Port ST forms the flow path, for pressurized fluids in the tubing to enter the intensifier. Port RT is open to chamber 116 and to the tubing-casing annulus 103 through a port 120 in the wall of tubing 102. Annulus 103 forms a lower pressure area for return fluids leaving port RT.

Port HT is open to chamber 118 and to the chamber 122 in packer element 124, of actuator 126. A port 128 is formed in the wall of tubing 102 to connect port HT and chamber 122. Ports HT and 128 provide a flow path for high-pressure fluids pumped form the intensifier 10 in well tool 100.

Although not shown it is to be understood that ports 120 and 128 can be closed by sleeves or the like (not shown) that are opened when the well tool 100 is landed on the landing nipple 108 in a manner well known in the industry.

In operation, well tool 100 is lowered or pumped down the tubing 102 to contact the landing nipple 108. The tool 100 and its packing connects port RT to port 120 and port HT to port 128. The fluid pressure in tubing 102 is next increased. Initially the fluid pressure from tubing 102 flows to the intensifier 10 thought port ST and through the intensifier to the actuator 126 through port HT. As the packer meets sufficient resistance the intensifier 10 begins the next step to pump fluid at a pressure higher than tubing fluid pressure to the actuator. Once the packer is completely set wire line 130 or other means can be used to remove the tool 100 from the well. In this manner downhole hydraulically actuated equipment can be manipulated at pressures higher than tubing pressure limits.

Figure 4:
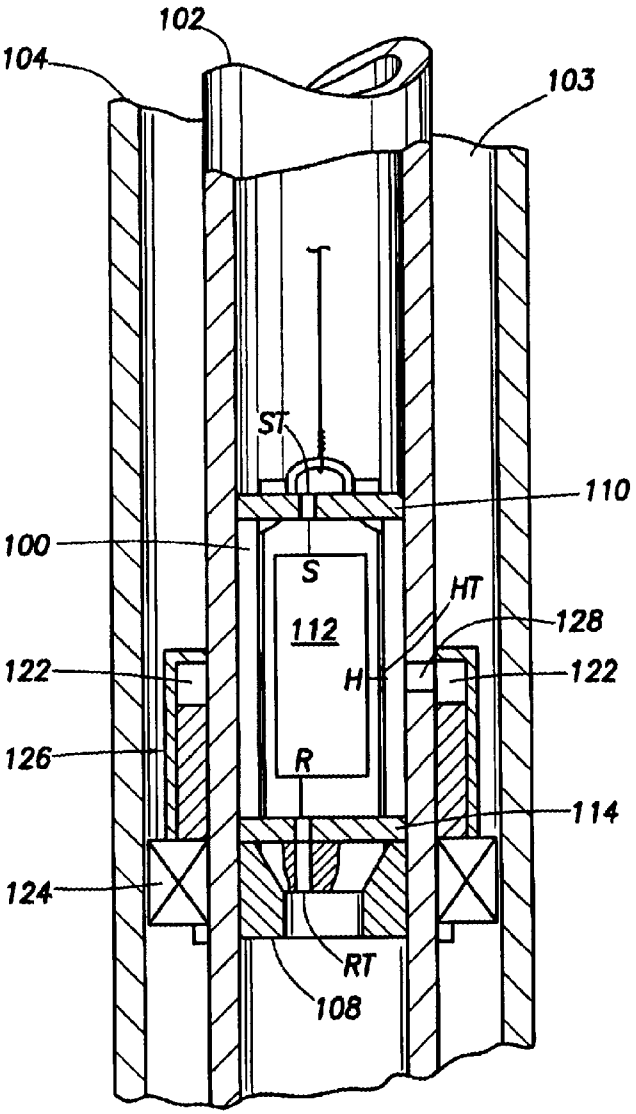
FIG. 4 is a sectional view similar to FIG. 3 illustrating an alternative embodiment of a well tool configuration of the present invention.

In FIG. 4 an alternative embodiment of the well tool 100 A of the present invention is illustrated. In this embodiment the center V-packer, element 112 and port 120 are eliminated. Discharge of return fluid is through the port RT in the bottom of the tool 100 A. Port RT communicates with the interior of the tubing 102 below the lower V-packing 114. In operation, tubing 102 is pressurized once the tool 100 A is in place on landing nipple 108. Pressurized fluid enters the port ST and is conducted to port S on intensifier 112. Intensifier 112 supplies high-pressure fluid to the packer actuator 126 through ports H, HT and 128. Return fluid exits intensifier from port R and RT to the tubing below the tool 100 A.

Figure 5:
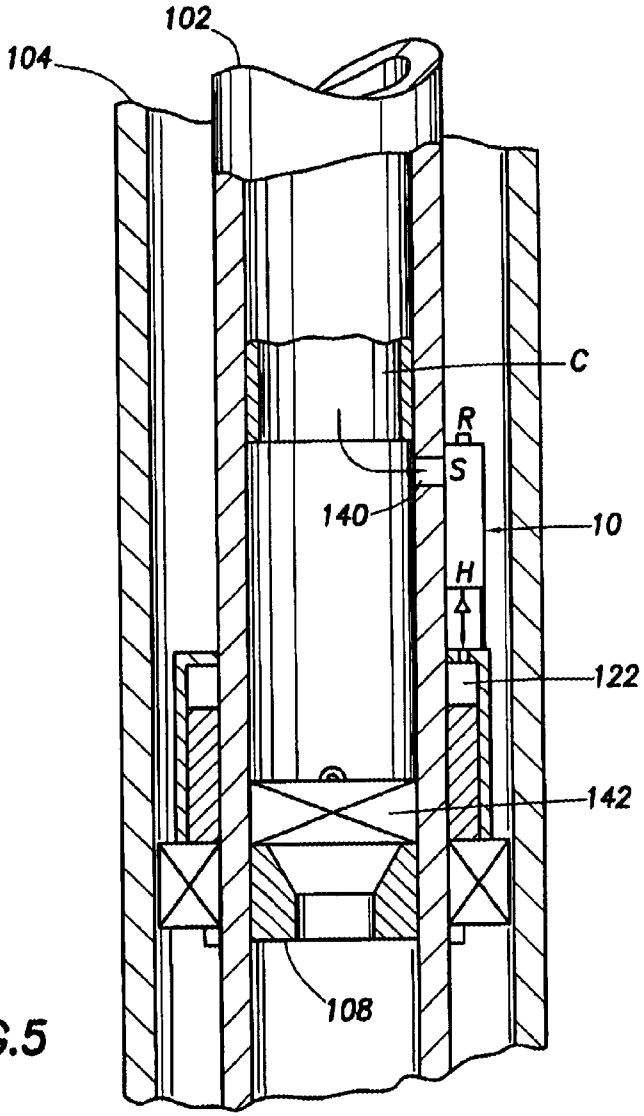
FIG. 5 is a sectional view similar to FIG. 3 illustrating a second alternative embodiment of the well tool configuration of the present invention.

In FIG. 5 the intensifier 10 is connected to the tubing 102 and is installed in the well with the tubing. A port 140 is formed in the wall of the tubing and is connected to the supply port S on the intensifier 10. A suitable closure sleeve C for the port 140 can be provided and opened as required such as in conventional down hole hydraulically operated equipment such as packers. Although the intensifier is illustrated as having a cylindrical piston, it is anticipated that the intensifier could be formed with annular pistons and cylinders similar to those used in conventional packers and could be integrally formed in the downhole tool such as a packer. The high-pressure output port H of the intensifier 10 is connected to the chamber 122 of the packer actuator 126. The return port R of the intensifier 10 is vented to the annulus 103. In operation, a plug 142 is set in a conventional manner on landing nipple 108. Plug 142 has V-packing or the like which seals against the interior of the tubing. Typically, the plug has means for opening the port 140 to connect the supply port S on the intensifier 10 to the interior of the tubing 102 above the plug. As described above in reference to other figures the intensifier will first convey pressurized tubing fluid to the packer actuator and when it stalls, will pump higher-pressure fluid to packer actuator to complete the actuation process. Once the packer is actuated, plug 142 is pulled from the well and 140 is preferably closed with a sliding sleeve or the like as is well known in the art.

Although the tools and actuation systems of FIGS. 3–5 were illustrated and described using the simple intensifier system of FIG. 2A, it is intended that the systems of FIGS. 3–5 could use the hydraulic supply tanks of FIGS. 2B and 2C. The tanks could be mounted on and carried downhole with the tool or could be installed with the downhole equipment to be hydraulically actuated.

The embodiments shown and described above are only exemplary. Many details are often found in the art such as: valves, connectors, packers, intensifiers, ports and the like. Therefore many such details are neither shown nor described. It is not claimed that all of the detail parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed:

1. A tool for use in a subterranean pressurized fluid located in the tubing of a cased well to manipulate a subterranean fluid actuated device by supplying fluid to an inlet port on the device at a pressure elevated above tubing fluid pressure, said tool comprising:

a body of a size to pass through the tubing;

a fluid pressure intensifier on the body, the intensifier having an inlet port in fluid communication with the tubing fluid and an outlet port delivering fluid at a pressure elevated above tubing fluid pressure, and the intensifier having a control valve to selectively direct flow between a low-pressure chamber and a high-pressure chamber, and a fluid conductor connected to the outlet port on the pressure intensifier, the conductor being adapted to connect to the inlet port on the subterranean device to thereby manipulate the device by fluid actuation from the supply of fluid at a pressure above tubing fluid pressure.

2. The tool of claim 1 additionally comprising a tubing plug on the body of the type that can be installed to close the tubing and isolate the interior of the tubing below the plug from tubing fluid pressure in the tubing above the plug.

3. The tool of claim 1 for use in a well having a subterranean return flow passageway communicating between the interior and exterior of the well tubing and wherein the tool additionally comprises a return port on the intensifier, a second fluid conductor on the body in fluid communication with the return port on the intensifier, the second fluid conductor being adapted to connect to the flow passageway when the tool is located in the well tubing whereby fluid can be discharged from the intensifier to the exterior of the tubing.

4. The tool of claim 1 wherein the inlet port of the pressure intensifier is in fluid communication with the pressurized tubing fluid when the tool is inserted in the well tubing.

5. The tool of claim 1 wherein the fluid supplied at the outlet port of the intensifier exceeds the maximum rated tubing pressure.

6. The tool of claim 1 wherein the fluid supplied at the outlet port of the intensifier is from about 1.2 to 20 times greater than the tubing fluid pressure at the intensifier supply port.

7. The tool of claim 1 wherein the subterranean device is a packer.

8. The tool of claim 1 wherein the subterranean device has a piston-cylinder assembly actuator.

9. The tool of claim 1 wherein the intensifier comprises:

a housing;

a low-pressure piston mounted for reciprocating motion in a low-pressure chamber within the housing;

a high-pressure piston connected to the low-pressure piston and mounted for reciprocating motion in a high-pressure chamber within the housing;

a valve in the housing comprising a control valve to receive fluid flow from the inlet port of the pressure intensifier and selectively direct the fluid flow to the low-pressure chamber to cause the low-pressure piston to reciprocate and cause the high-pressure piston to reciprocate, and to direct fluid from the low-pressure chamber means to a return port; and a fluid passageway arranged to direct fluid flow from the inlet port of the pressure intensifier into the high-pressure chamber and to direct higher-pressure fluid from the high-pressure chamber to the high-pressure fluid outlet port of the pressure intensifier.

10. The tool of claim 2 additionally comprising a return port on the intensifier, a fluid passage in fluid communication with the return port and with the lower side of the plug whereby fluid is discharged from the intensifier.

11. A tool for use in the a subterranean pressurized fluid located in the tubing of a cased well to manipulate a subterranean fluid actuated device by supplying fluid to an inlet port on the device at a pressure elevated above tubing fluid pressure, said tool comprising:

a body of a size to pass through the tubing; and a self-contained, oscillating pump fluid pressure intensifier on the body having a low-pressure piston, a high-pressure piston, a bistable reversing valve, a supply port in fluid communication with the tubing fluid, an outlet port for delivering fluid from the supply port at a pressure elevated above tubing fluid pressure.

12. A tool for use in the a subterranean pressurized fluid located in the tubing of a cased well to manipulate a subterranean fluid actuated device by supplying fluid to an inlet port on the device at a pressure elevated above tubing fluid pressure, said tool comprising:

a body of a size to pass through the tubing; and a self-contained, oscillating pump pressure intensifier means on the body having a low-pressure piston, a high-pressure piston, a bistable reversing valve, a supply port in fluid communication with the tubing fluid and an outlet port for connection to the fluid actuated device for delivering fluid from the supply port at a pressure elevated above tubing fluid pressure.

13. A tool for use in the a subterranean pressurized fluid located in the tubing of a cased well to manipulate a subterranean fluid actuated device by supplying fluid to an inlet port on the device at a pressure elevated above tubing fluid pressure, said tool comprising:

a self-contained body of a size to pass through the tubing;

a fluid supply inlet on the body for receiving pressurized fluid from the tubing and a fluid outlet on the body for communication with the inlet port on the device, and an oscillating pump means on the body connected from for removing fluid from the fluid supply port inlet and elevating the pressure of the fluid and discharging to the fluid through the fluid outlet.

14. A method of providing actuating fluid to a supply port on a fluid operable apparatus located in a subterranean location in a well to operate the apparatus, the well having an annulus formed between well tubing and casing, the method comprising:

moving a self-contained well tool into the well tubing to a location adjacent the fluid operable apparatus, the tool having a high-pressure discharge port;

placing the high-pressure discharge port in fluid communication with the supply port of the fluid operable apparatus;

providing pressurized fluid to the interior of the tubing, and operating the well tool from the pressurized fluid present in the tubing to first supply pressurized fluid to the hydraulically operable apparatus at the pressure of the fluid in the tubing until the apparatus stalls and thereafter supplying fluid at a pressure in excess of the pressurized fluid to the fluid operable apparatus to thereby overcome to stall and complete the actuation thereof.

15. A method of providing actuating fluid to a supply port on a hydraulically operable apparatus located in a subterranean location in a well having a tubular member in the well as in claim 14; wherein the well tool has a first and second chambers, the method further comprising producing pressure in the first chamber supplied to the fluid operable apparatus in excess of the pressure in the second chamber.

16. A method of providing actuating fluid to a supply port on a hydraulically operable apparatus located in a subterranean location in a well having a tubular member in the well as in claim 15, the method further comprising:

producing pressure in the first chamber from about 1.2 to 20 times greater than the pressure in the second chamber.

17. A method of providing actuating fluid to a supply port on a hydraulically operable apparatus located in a subterranean location in a well having a tubular member in the well as in claim 15, the method further comprising:

producing pressure in the first chamber supplied to actuator in excess of tubing rated maximum pressure.

18. A tool for use in a subterranean pressurized fluid located in the tubing of a cased well to manipulate a subterranean fluid actuated device by supplying fluid to an inlet port on the device at a pressure elevated above tubing fluid pressure, said tool comprising:

a body of a size to pass through the tubing;

a fluid pressure intensifier on the body, the intensifier having an inlet port in fluid communication with the tubing fluid and an outlet port delivering fluid at a pressure elevated above tubing fluid pressure;

a fluid conductor connected to the outlet port on the pressure intensifier, the conductor being adapted to connect to the inlet port on the subterranean device to thereby manipulate the device by fluid actuation from the supply of fluid at a pressure above tubing fluid pressure, and a return port on the intensifier, a fluid passage in fluid communication with the return port and with the interior of the tubing below the plug whereby fluid is discharged from the intensifier.

19. A tool for use in a subterranean pressurized fluid located in the tubing of a cased well to manipulate a subterranean fluid actuated device by supplying fluid to an inlet port on the device at a pressure elevated above tubing fluid pressure, the well having a subterranean return flow passageway communicating between the interior and exterior of the well tubing, said tool comprising:

a body of a size to pass through the tubing;

a fluid pressure intensifier on the body, the intensifier having an inlet port in fluid communication with the tubing fluid and an outlet port delivering fluid at a pressure elevated above tubing fluid pressure;

a fluid conductor connected to the outlet port on the pressure intensifier, the conductor being adapted to connect to the inlet port on the subterranean device to thereby manipulate the device by fluid actuation from the supply of fluid at a pressure above tubing fluid pressure, and a return port on the intensifier, a second fluid conductor on the body in fluid communication with the return port on the intensifier, the second conductor being adapted to connect to the return flow passageway when the tool is located in the well tubing whereby fluid can be discharged from the intensifier to the exterior of the tubing.

20. A tool for use in a subterranean pressurized fluid located in the tubing of a cased well to manipulate a subterranean fluid actuated device by supplying fluid to an inlet port on the device at a pressure elevated above tubing fluid pressure, said tool comprising:

a body of a size to pass through the tubing;

a fluid pressure intensifier on the body, the intensifier having an inlet port in fluid communication with the tubing fluid and an outlet port delivering fluid at a pressure elevated above tubing fluid pressure;

a fluid conductor connected to the outlet port on the pressure intensifier, the conductor being adapted to connect to the inlet port on the subterranean device to thereby manipulate the device by fluid actuation from the supply of fluid at a pressure above tubing fluid pressure, the fluid pressure intensifier having a housing;

a low-pressure piston mounted for reciprocating motion in a low-pressure chamber within the housing;

a high-pressure piston connected to the low-pressure piston and mounted for reciprocating motion in a high-pressure chamber within the housing;

a valve in the housing comprising a control valve to receive fluid flow from the inlet port of the pressure intensifier and selectively direct the fluid flow to the low-pressure chamber to cause the low-pressure piston to reciprocate and cause the high-pressure piston to reciprocate, and to direct fluid from the low-pressure chamber to a return port; and a fluid passageway arranged to direct fluid flow from the inlet port of the pressure intensifier into the high-pressure chamber and to direct higher-pressure fluid from the high-pressure chamber to the outlet port of the pressure intensifier.

21. A method of making a subterranean well comprising the steps of:

excavating a well;

installing a length of casing in the well;

inserting a length of tubing in the casing;

forming an annulus between the tubing and casing;

placing a fluid operable well tool in the well at a subterranean location, the well tool having a supply port for receiving fluid actuation fluid, placing a fluid pressure intensifier in the well at a subterranean location, the fluid pressure intensifier having a high-pressure discharge port, a return port and a supply port; the intensifier discharge port in fluid communication with the supply port of the fluid operable well tool; the intensifier supply port connected to the interior of the length of well tubing, and the intensifier return port connected to the annulus;

supplying fluid to the interior of the length of well tubing at a tubing fluid pressure;

supplying fluid to the supply port of the fluid operable well tool at a fluid pressure above the tubing fluid pressure; and discharging fluid from the intensifier return port to the annulus.

* * * * *